United States Patent [19]

Ganz et al.

[11] Patent Number: 4,934,453

[45] Date of Patent: Jun. 19, 1990

[54] HEAT EXCHANGER MODULE OF FIRED CERAMIC MATERIAL

[75] Inventors: Rudolf Ganz, Mainz; Otto Heinz, Neu-Isenburg; Heinrich Schelter, Selb, all of Fed. Rep. of Germany

[73] Assignee: Hoechst Aktiengesellschaft, Fed. Rep. of Germany

[21] Appl. No.: 430,666

[22] Filed: Nov. 2, 1989

Related U.S. Application Data

[63] Continuation of Ser. No. 134,013, Dec. 17, 1987, abandoned.

[30] Foreign Application Priority Data

Dec. 20, 1986 [DE] Fed. Rep. of Germany ..... 3643750

[51] Int. Cl.[5] ..... F28F 7/00

[52] U.S. Cl. ..... 165/165; 165/164; 165/905; 165/166

[58] Field of Search ..... 165/4, 9.1–9.4, 165/165–167, 905

[56] References Cited

U.S. PATENT DOCUMENTS

| | | | |
|---|---|---|---|
| 1,775,041 | 9/1930 | Karmazin | 165/151 |
| 1,982,931 | 12/1934 | Schanck et al. | 165/151 |
| 2,166,375 | 7/1939 | Schwarze | 165/9.1 |
| 2,246,258 | 6/1941 | Lehman | 165/151 X |
| 3,409,075 | 11/1968 | Long | 165/164 |
| 3,591,153 | 7/1971 | Powell | 165/9.3 |
| 4,107,919 | 8/1978 | Sokolowski | 165/169 X |
| 4,368,779 | 1/1983 | Rojey et al. | 165/165 |
| 4,423,771 | 1/1984 | Frederick | 165/151 |
| 4,432,408 | 2/1984 | Caines | 165/905 X |
| 4,437,217 | 3/1984 | Lallaye et al. | 165/905 X |
| 4,550,776 | 11/1985 | Lu | 165/151 |
| 4,624,305 | 11/1986 | Rojey | 165/165 |
| 4,741,792 | 5/1988 | Matsuhisa et al. | 165/10 X |

FOREIGN PATENT DOCUMENTS

| | | | |
|---|---|---|---|
| 57-155088 | 9/1982 | Japan | 165/151 |

*Primary Examiner*—Martin P. Schwadron
*Assistant Examiner*—Allen J. Flanigan
*Attorney, Agent, or Firm*—Connolly and Hutz

[57] ABSTRACT

In a heat exchanger module of fired ceramic material produced from a stack of punched and laminated green ceramic cards, the stack comprises at least two cards. The cards have first cut-outs (1) which, in stacked cards, form tubular channels (12) and second cut-outs (2, 4, 7, 8) which are positioned around the first cut-outs (1) and which, in stacked cards, partially overlap with the second cut-outs (2, 4, 7) of adjacent cards. Channels (13) which lie in the plane of the cards and surround the tubular channels (12) are thus formed.

8 Claims, 6 Drawing Sheets

22
22
15
20
18
20
19
17
19
17
11
21
21
12
13
11
14
16
11
21
21
13
13
12
12
VIII
VIII
11
19
19
11
11'
17'
11'
17'
15
22
22

HEAT EXCHANGER MODULE OF FIRED CERAMIC MATERIAL

CROSS-REFERENCE TO RELATED APPLICATION

The present application is a continuation of application Ser. No. 134,013, filed Dec. 17, 1987, now abandoned.

BACKGROUND OF THE INVENTION

The invention relates to a heat exchanger module of fired ceramic material which is produced by firing a stack of punched and laminated green ceramic cards.

Heat exchangers of the type referred to are known from U.S. Pat. No. 4,526,635. They are produced from ceramic foils or cards in which the flow channels are punched or stamped and which are joined together with the aid of laminating devices. The heat exchanger block obtained in this way is first heated and the organic constituents are burned out at 200°-300° C. The block is then fired at 1200° to 1700° C. The disadvantages are the great number of different card patterns for the construction of the block, the refinishing work on the green block and the fired block and the restricted possibilities for cleaning the channels. The invention is intended to remedy these. It is intended to make it possible to produce the heat exchanger with a minimum of card patterns and to use it in like manner for particle-laden gas streams and for liquid/gas and liquid/liquid heat exchange.

SUMMARY OF THE INVENTION

The object is achieved by a heat exchanger module wherein the stack comprises at least two cards, the cards having first cut-outs which, in stacked cards, form tubular channels and second cut-outs which are positioned around the first cut-outs and which, in stacked cards, partially overlap with the second cut-outs of adjacent cards, channels being formed which lie in the plane of the cards and surround the tubular channels. The second cut-outs can be slot-shaped or angular. The inner side of the angle can have a circular boundary which is concentric with the first cut-out. The second cut-outs of the first card can be slot-shaped and those of the second card can be circular. The slots can have lengths of 1 to 3 diameters of the first cut-outs.

The advantages achieved by the invention lie essentially in the fact that the module can be constructed from one up to a maximum of two card patterns; there is no punching and positioning of spacers and baffle plates; simple construction of a heat exchanger system from such modules; reliable seating of the material flows from one another in the module due to bonding over a large area between the individual cards. Around the tubular, straight channels for the hot medium (first cut-outs) and the slot-shaped channels there is sufficient remaining material forming the columns and tubes which are to be laminated together over the height of the module, which can be compressed under high pressure, for it to be possible to avoid laminar defects. If necessary the sealing of the fired module can be improved by a second firing and introduction of sealing agents, for example silicon or a glaze, via the tubular channels inside the module intended for the warm medium. The heat exchanger module is especially suitable for constructing heat exchanger systems. In this case it is advantageous if the modules are placed on top of one another to form columns. In this configuration the hot medium is passed in straight lines through the column-shaped construction. Alternatively the modules can be seated to one another by glueing with organic or inorganic glues, mortars, glazes and the like. However, normal sealing elements such as fiber cord, fiber paper, O-rings, C-seals, etc. are also suitable. The sealing surfaces can be structured or ground. Any number of columns can be installed in a heat exchanger housing. In this case, it is sufficient to brace the individual columns against a fixed support with sprung elements to compensate for thermal expansions. Rigid connection of the columns to one another is not required. However, they can be positioned by guide elements pushed into the guide grooves of the module. The guide elements can be shaped so that at the transition from one column to the next the cold medium is always passed into the inside of the module. Through the configuration of the heat exchanger housing the mode of operation of the heat exchanger can be changed from, for example, cross to cross-counter current without changing the column design.

BRIEF DESCRIPTION OF THE DRAWING

The invention is described in detail below with the aid of drawings showing just one embodiment in which.

DETAILED DESCRIPTION OF THE INVENTION

Figure 1:
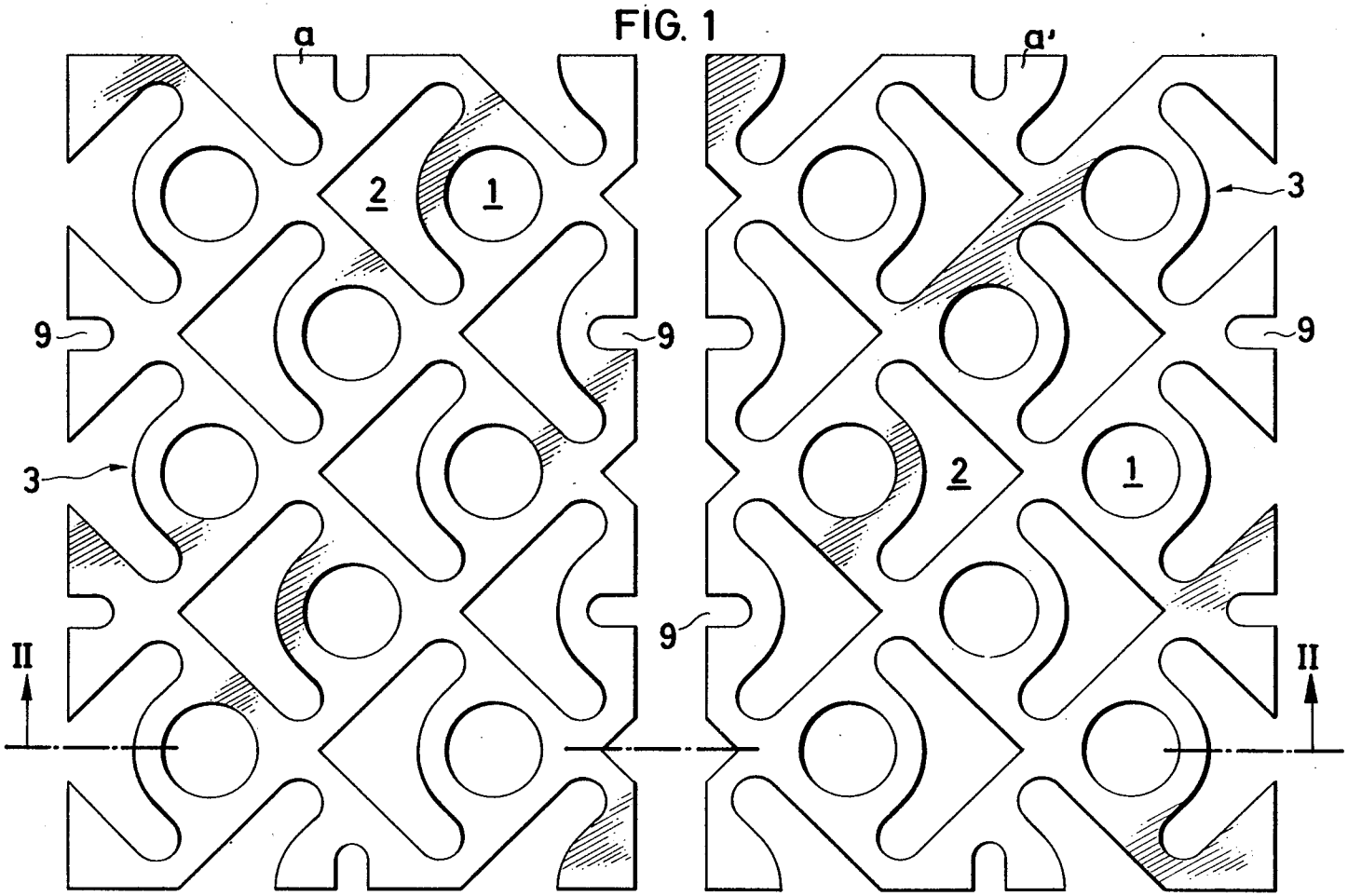
FIG. 1 shows punched cards with identical patterns for constructing a heat exchanger module.

The card pattern as shown in FIG. 1 has circular cut-outs 1 as the first cut-out and around these are the angular cut-outs 2 as the second cut-outs, the inner side of the angle being shaped as the circular boundary 3. Two stacks a and a′ are formed from these cards, the stack a′ being formed by turning over the cards from stack a. The heat exchanger module is constructed by alternate superimposition of the cards from stacks a and a′. This results in straight-through, tubular channels 12 and, perpendicular to them, slot-shaped channels 13 which surround the tubular channels and lie alternately in one or more card planes.

Figure 2:
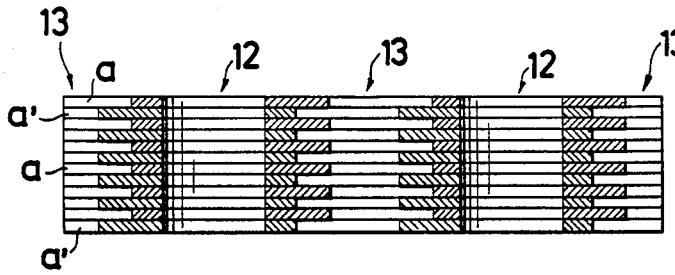
FIG. 2 shows the section II—II from FIG. 1 of a heat exchanger module.
Figure 4:
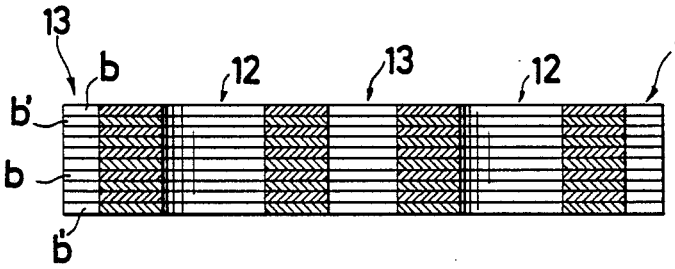
FIG. 4 shows the section IV—IV from FIG. 3 of a heat exchanger module.
Figure 3:
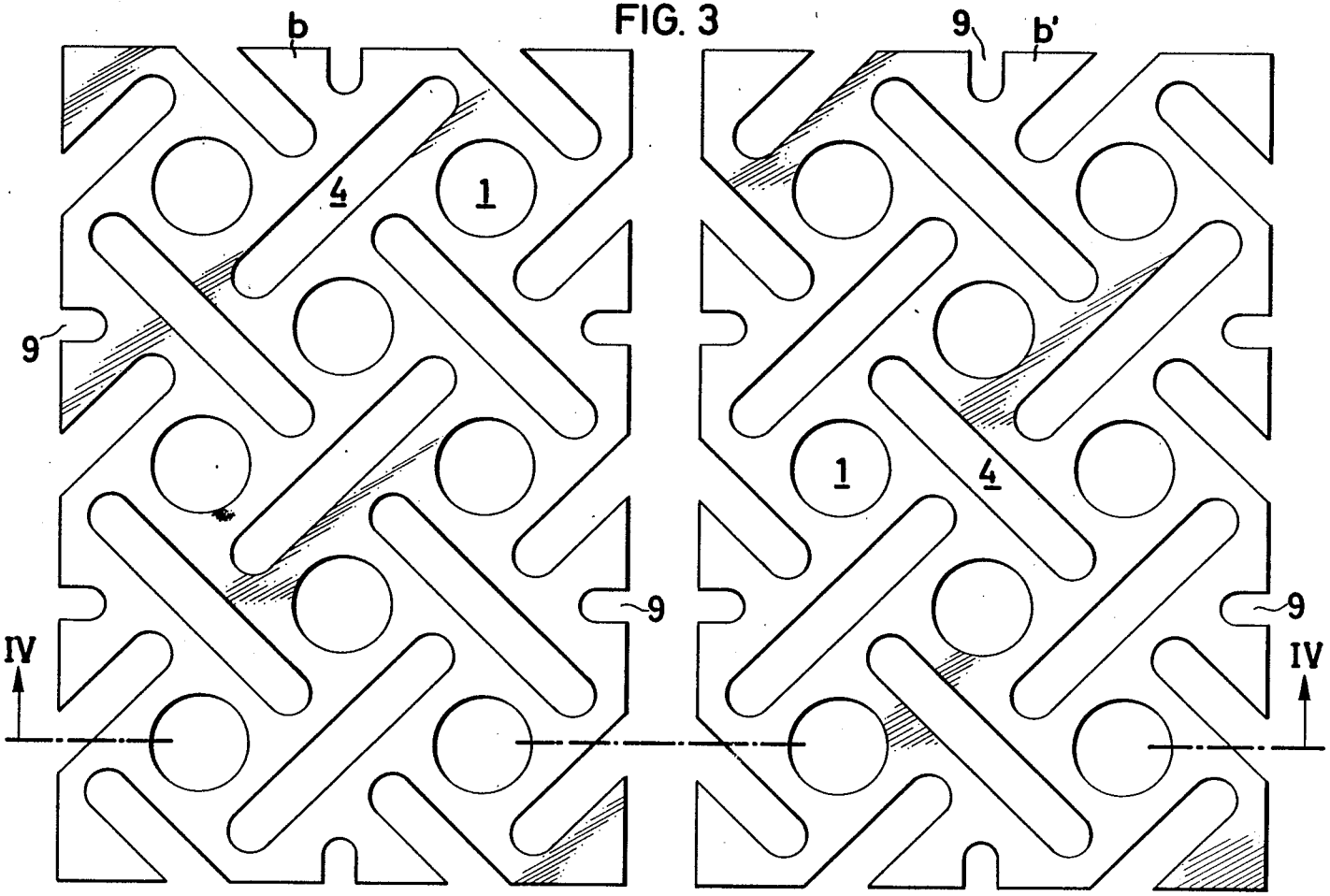
FIG. 3 shows differently punched cards with identical patterns for constructing a heat exchanger module.
Figure 5:
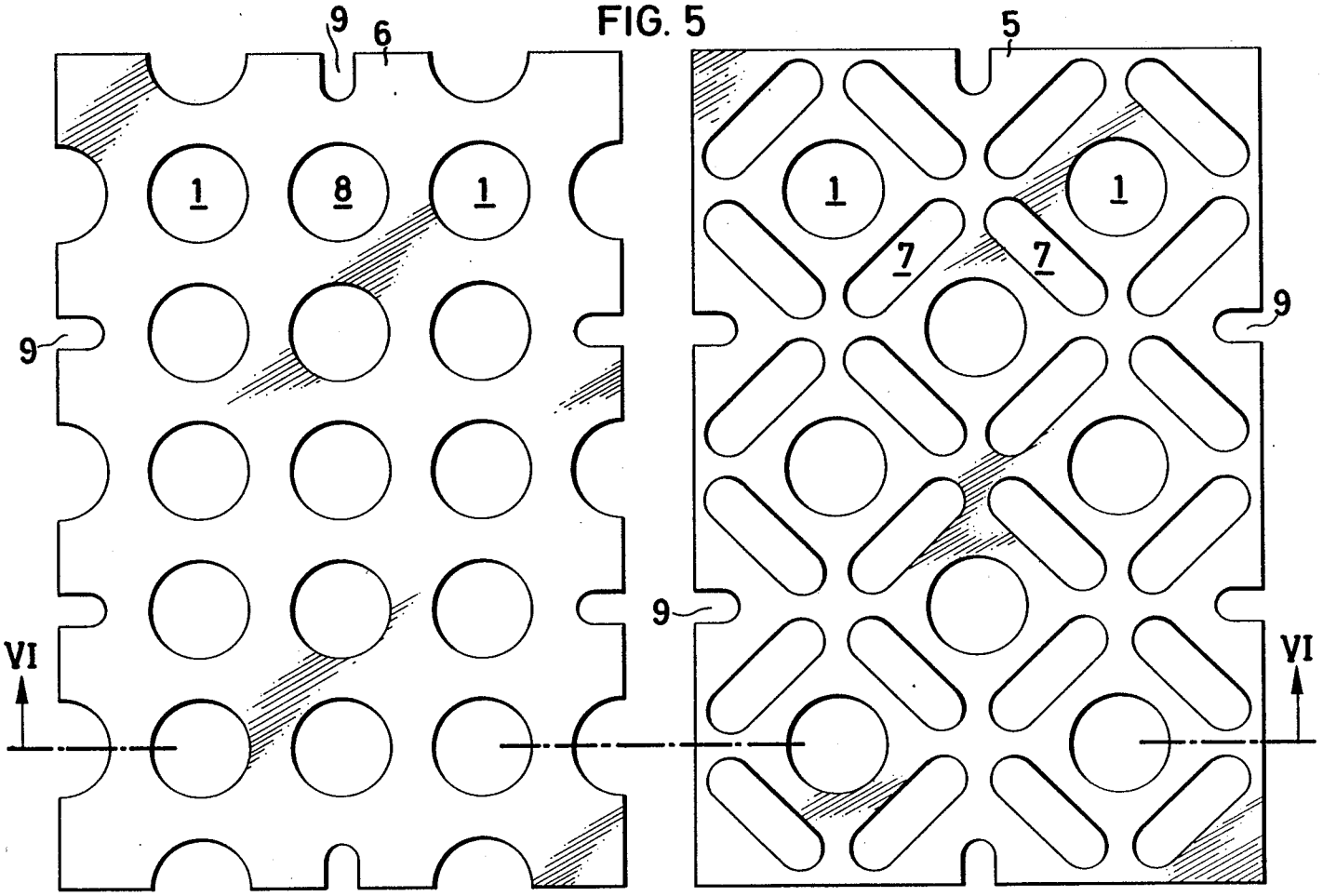
FIG. 5 shows a further alternative with two card patterns for constructing a heat exchanger module.

The heat exchanger module as shown in FIG. 4 is also constructed in a similar manner. It differs from the heat exchanger module as shown in FIG. 2 only in the card pattern. Slot-shaped second cut-outs 4 are positioned around the circular first cut-outs 1 (FIG. 3). The heat exchanger module is constructed by alternate superimposition of the cards from stacks b and b′.

Figure 6:
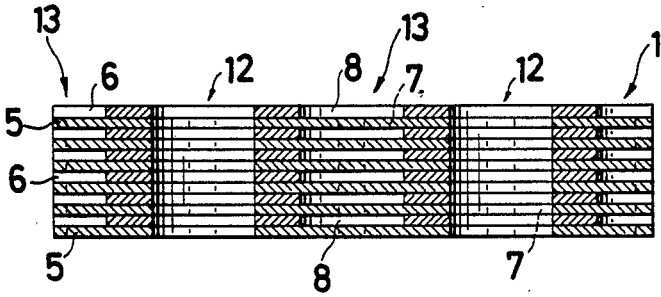
FIG. 6 shows a section VI—VI from FIG. 5 of a heat exchanger module.

The heat exchanger module as shown in FIG. 6 is constructed from two different card patterns 5 and 6, which are stacked alternately on top of one another. Card pattern 5 has circular first cut-outs 1 and slot-shaped second cut-outs 7 around them, while the second card pattern 6 has circular first cut-outs 1 and circular second cut-outs 8. With alternate stacking of the two card patterns the cut-outs 1 form tubular channels 12, while the cut-outs 8 each bridge four opposing ends of the slots 7 so that they form the slot-shaped channels 13 in the card plane.

The height of the channels 13, in which the flow direction runs essentially transverse to the tubular channels 12, can be varied by stacking several cards of one stack a, a', b, b' or the card patterns 5 or 6 on top of one another. The perforations 9 at the edge of the card (FIGS. 1, 3, 5, 8) can be used to take stacking aids, guide elements, assembly aids 10, etc.

Figure 7:
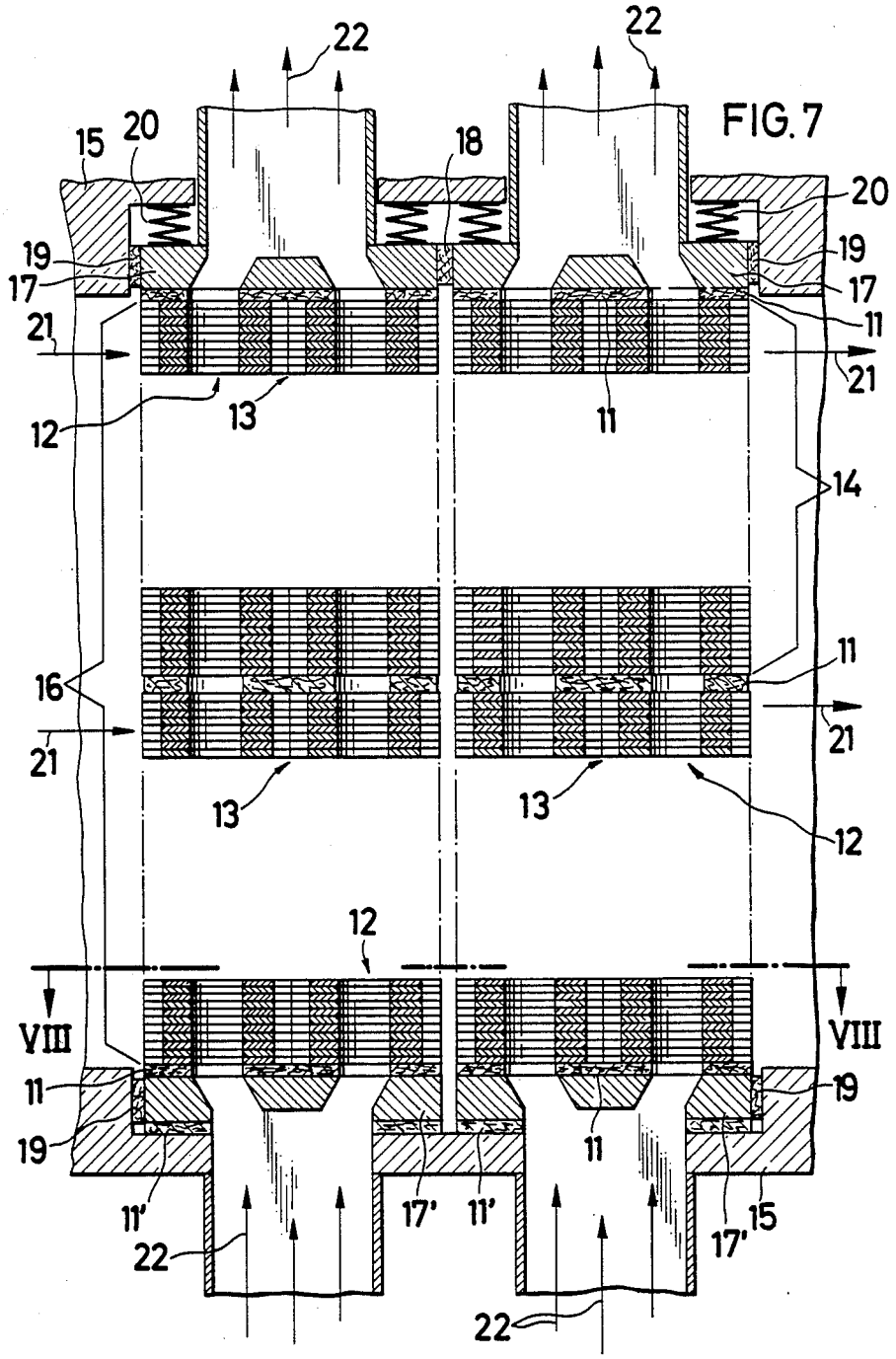
FIG. 7 shows a heat exchanger system constructed from heat exchanger modules composed of cards as shown in FIG. 3, and specifically shows the section VII—VII from FIG. 8.
Figure 8:
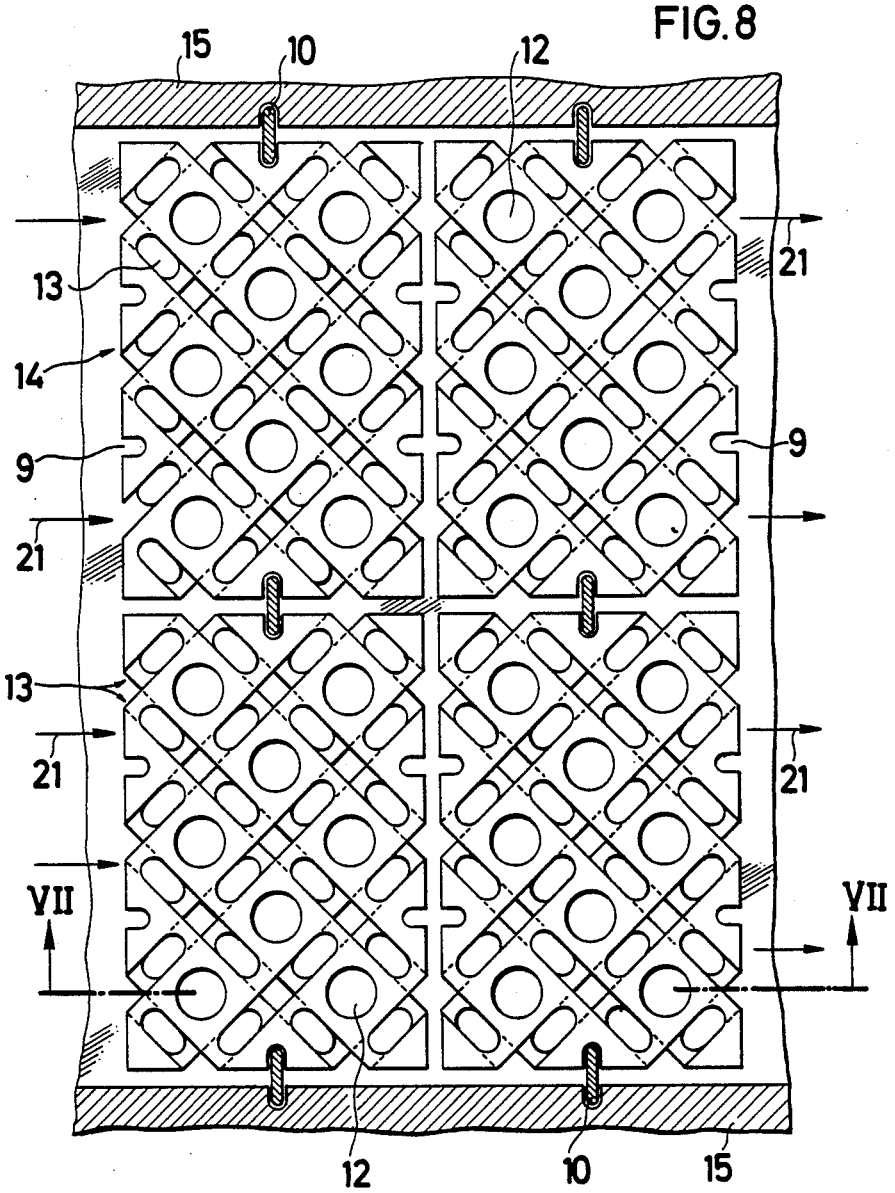
FIG. 8 shows the section VIII—VIII from FIG. 7.

In the heat exchanger system as shown in FIGS. 7 and 8 heat exchanger modules 14 are assembled to form columns 16 which are positioned parallel to one another in a housing 15. The individual columns 16 are fixed in terms of their positions relative to one another and in relation to the housing 15 by assembly aids 10 which can also be formed as guide elements. Seals 11 are positioned between the modules 14 of a column 16 to prevent the heat exchanger media from intermixing. The ends of the individual columns 16 are also sealed against the housing 15 by seals 11. To take up the longitudinal expansions of the columns 16 caused by temperature the columns 16 are positioned on bearing elements 17, 17' which are sealed against the columns 16 with seals 11 and against the housing 15 with seals 11', 18 and 19. While the bearing element 17' is supported directly on the housing 15 by the seal 11' the bearing element 17 is supported on the housing 15 by springs 20. 21 indicates the direction of flow of the cold medium and 22 the direction of flow of the hot medium.

We claim:

1. A heat exchanger module of fired ceramic material produced from a stack of punched and laminated ceramic cards, the stack comprising at least two cards, each card having a plurality of first cut-outs (1) aligned to form tubular channels (12) when the cards are superimposed one above the other in engagement with one another and a plurality of second cut-outs (2,4,7,8) which are positioned around the first cut-outs (1) and which are arranged to partially overlap and misalign with the second cut-outs (2,4,7) of adjacent cards in the stack to form second channels (13) which lie in the plane of the cards and surround the tubular channels (12); alternate cards in said stack having said first and second cut-outs arranged therein such that each first cut-out is entirely surrounded by second cut-outs, whereby any two adjacent first cut-outs have disposed therebetween at least a portion of one or more second cut-outs.

2. The heat exchanger module as claimed in claim 1, wherein the second cut-outs (4, 7) are slot-shaped.

3. The heat exchanger module as claimed in claim 1, wherein the second cut-outs (2) are angular.

4. The heat exchanger module as claimed in claim 3, wherein each said angular second cutout comprises a circular boundary (3) which is concentric with a first cut-out (1).

5. The heat exchanger module as claimed in claim 1, wherein the second cut-outs (7, 8) of one card (5) are slot-shaped and those of an adjacent card (6) are circular.

6. The heat exchanger module as claimed in claim 1, wherein the first cut-outs (1) forming the tubular channels (12) are circular.

7. The heat exchanger module as claimed in claim 1, wherein each first cut-out (1) in at least one of said at least two cards is surrounded by four slots (4, 7) positioned at right-angles to one another.

8. The heat exchanger module as claimed in claim 7, wherein the slots (4, 7) have lengths of one to three diameters of the first cut-outs (1).

* * * * *